US006720489B2

(12) United States Patent
Revenaugh

(10) Patent No.: US 6,720,489 B2
(45) Date of Patent: Apr. 13, 2004

(54) PIANO MUTER

(76) Inventor: Daniell Revenaugh, 2531 Etna St., Berkeley, CA (US) 94704

( * ) Notice: Subject to any disclaimer, the term of this patent is extended or adjusted under 35 U.S.C. 154(b) by 0 days.

(21) Appl. No.: 10/166,804

(22) Filed: Jun. 10, 2002

(65) Prior Publication Data

US 2003/0226439 A1 Dec. 11, 2003

(51) Int. Cl.[7] ..... G10C 3/02

(52) U.S. Cl. ..... 84/177; 84/174; 84/184; 84/185; 84/191; 84/239

(58) Field of Search ..... 84/177, 174, 182, 84/184, 185, 191, 239, 411 M, 287–289

(56) References Cited

U.S. PATENT DOCUMENTS 1,722,643 A * 7/1929 Trenor ..... 84/177
1,722,978 A * 7/1929 Hammond, Jr. ..... 84/182
5,301,588 A * 4/1994 Revenaugh et al. ..... 84/177
5,804,745 A * 9/1998 Higasa ..... 84/182

* cited by examiner

*Primary Examiner*—Shih-Yung Hsieh
(74) *Attorney, Agent, or Firm*—John Wiley Horton

(57) ABSTRACT

A muter configured to be placed beneath the soundboard of a piano (in the case of a grand piano) in order to attenuate the downward transmission of sound. The muter employs blocks of acoustic foam, shaped to frictionally engage the structural elements of the piano in order to retain the muter within the piano. The muter is easily installed and removed. A version configured for use with an upright piano is also disclosed.

18 Claims, 11 Drawing Sheets

PIANO MUTER

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of musical instruments. More specifically, the invention comprises a muter capable of diminishing the sound emitted by a piano.

2. Description of the Related Art

FIG. 1 illustrates a piano 10. It fundamentally consists of keyboard assembly 20, frame 12, and lid 14. Those skilled in the art will know that keyboard assembly 20 contains keys, along with attached hammer mechanisms configured to strike the strings when the user strikes a particular key. A large number of strings extend away from keyboard assembly 20 in a generally perpendicular direction, with the strings lying approximately in a single plane. The far end of each string is anchored, directly or indirectly, to frame 12.

All pianos are, of course, designed to produce tones covering a large bandwidth. This fact requires the use of strings having different lengths. Thus, the treble section of the keyboard (to the right in the view as shown) employs strings of shorter length than the mid section. This fact explains the curved shape of frame 12. The structure of a concert piano is therefore quite complex, in that it must encompass several curves.

Those skilled in the art will also know that pianos include a soundboard to amplify the sound produced by each vibrating string. This soundboard is typically a large flat panel, suspended beneath the strings. It is suspended in such a fashion as to minimize damping of any vibration induced by the moving strings. The soundboard is largely responsible for the rich tonal texture produced in a well-made piano. It substantially augments resonance. It also produces certain harmonic frequencies, owing to the tendency of the unified sound board to flex according to its own natural frequencies. Finally, the soundboard also tends to provide enhanced blending of different frequencies to produce beat frequencies.

If the operator strikes a first key in the bass range and a second key in the treble range, these two string sets are located remotely from each other (30 to 40 inches apart, typically). Although the human ear may perceive a beat frequency, the two strings are generally too far apart to produce sympathetic vibrations in each other. Because both sets are close to the soundboard, however, the soundboard can transmit the two frequencies and produce the desired sympathetic vibrations.

Lid 14 is hinged to frame 12. It is contoured to cover the open top of frame 12. The strings lie beneath lid 14 with the soundboard, in turn, lying beneath the strings. The hinge is typically placed on the left side of frame 12 in the view as shown. With lid 14 closed, some of the sound produced by piano 10 is trapped within. In a concert setting lid 14 would be propped open, in order to project sound out toward the audience. Thus, the reader will appreciate that lid 14 does provide some selective muffling of piano 10.

FIG. 2 shows a view of piano 10 from underneath. Piano strings are typically made of steel. They cumulatively place several thousand pounds of compression on frame 12. It is therefore necessary to strengthen frame 12. Anchor structure 22 is attached to keyboard assembly 20. A series of beams 24 extend radially forward from anchor structure 22, terminating in intersections with frame 12. End plate 28 stiffens the leading portion of frame 12, and serves to anchor one of the three legs 16. Numerous other structures, such as pedal assembly 18, are present. These other structures are unimportant to the present invention.

Soundboard 26 lies above beams 24. It is important to realize that there is a significant gap between the tops of beams 24 and soundboard 26. Again, soundboard 26 must be free to oscillate undamped.

Looking at FIG. 2, those skilled in the art will realize that soundboard 26 projects sound downward as well as upward. The closing of lid 14 does nothing to attenuate this downward transmission.

BRIEF SUMMARY OF THE INVENTION

The present invention comprises a muter configured to be placed beneath the soundboard of a piano (in the case of a grand piano) in order to attenuate the downward transmission of sound. The muter employs blocks of acoustic foam, shaped to frictionally engage the structural elements of the piano in order to retain the muter within the piano. The muter is easily installed and removed. A version configured for use with an upright piano is also disclosed.

REFERNECE NUMERALS IN THE DRAWINGS

Figure 1:
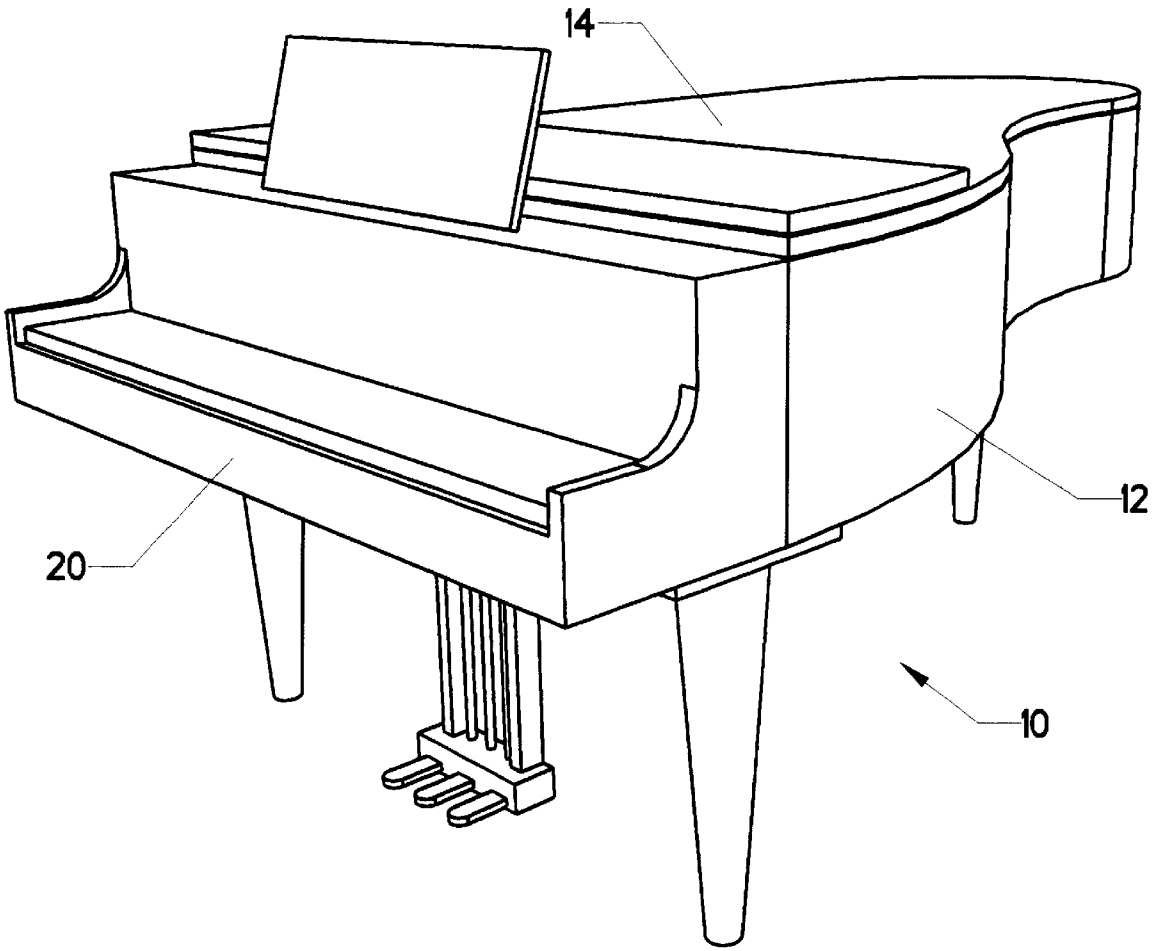
FIG. 1 (PRIOR ART)
FIG. 1 is a perspective view, showing a concert piano.

| REFERENCE NUMERALS IN THE DRAWING | |
|---|---|
| 10 piano | 12 frame |
| 14 lid | 16 leg |
| 18 pedal assembly | 20 keyboard assembly |
| 22 anchor structure | 24 beam |
| 26 soundboard | 28 end plate |
| 30 piano muter | 32 acoustic foam block |
| 34 sheet | 36 beam channel |
| 38 VELCRO panel | 40 acoustic foam |
| 42 NYLON shell | 44 VELCRO panel |
| 46 profile modified block | 48 beam gap |

DETAILED DESCRIPTION OF THE INVENTION

Figure 3:
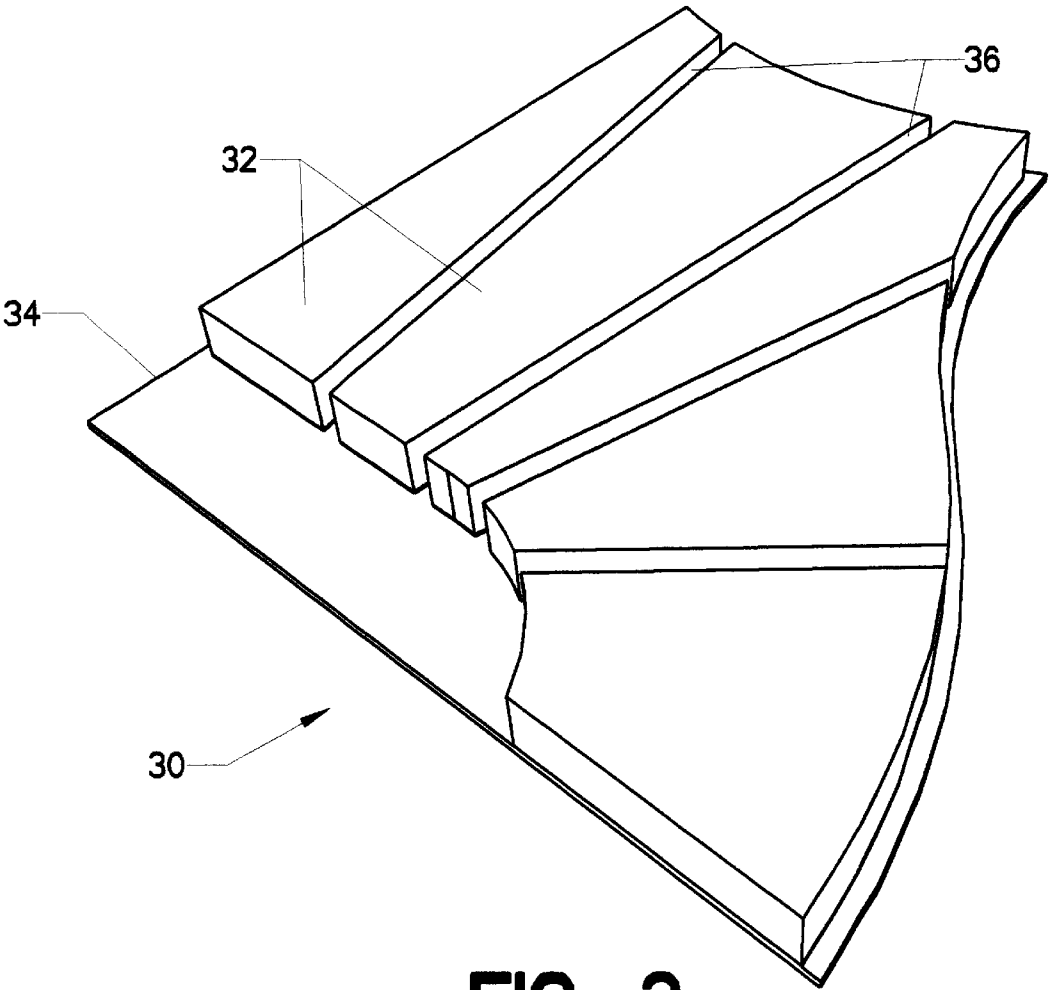
FIG. 3 is a perspective view, showing the proposed invention.

FIG. 3 shows an overall view of piano muter 30. The combined structure shown is a sound dampening element configured for installation next to a piano soundboard, on the side away from the piano strings. It consists essentially of an approximately planar sheet 34 attached to a group of acoustic foam blocks 32. Beam channels 36 lie between adjacent acoustic foam blocks 32.

Figure 2:
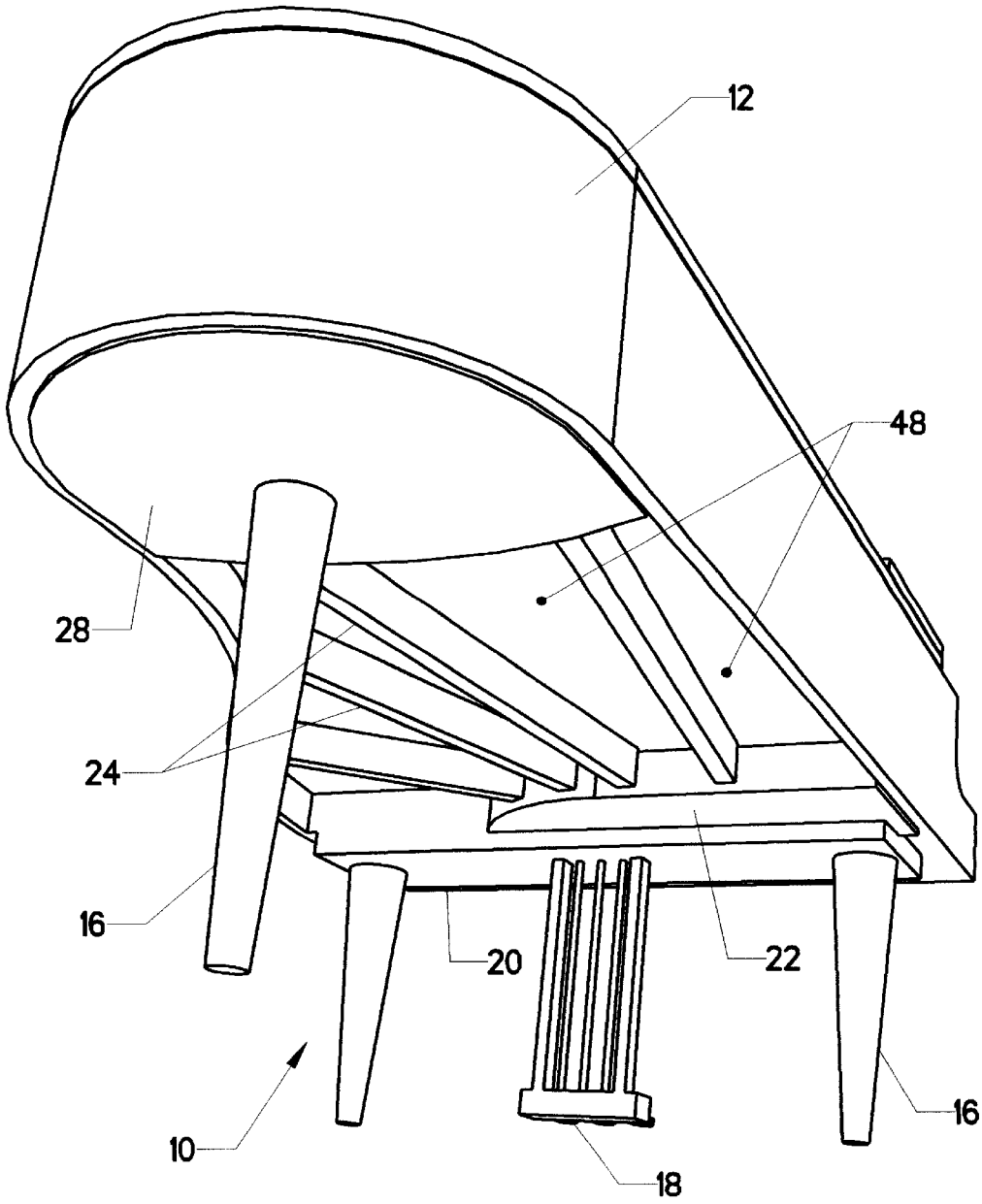
FIG. 2 (PRIOR ART)
FIG. 2 is a perspective view, showing a concert piano.

Returning briefly to FIG. 2, the reader will observe that numerous beam gaps 48 lie between beams 24. When piano muter 30 is installed, acoustic foam blocks 32 fit snugly within beam gaps 48. Stated conversely, beams 24 fit snugly within beam channels 36 on piano muter 30.

Figure 4:
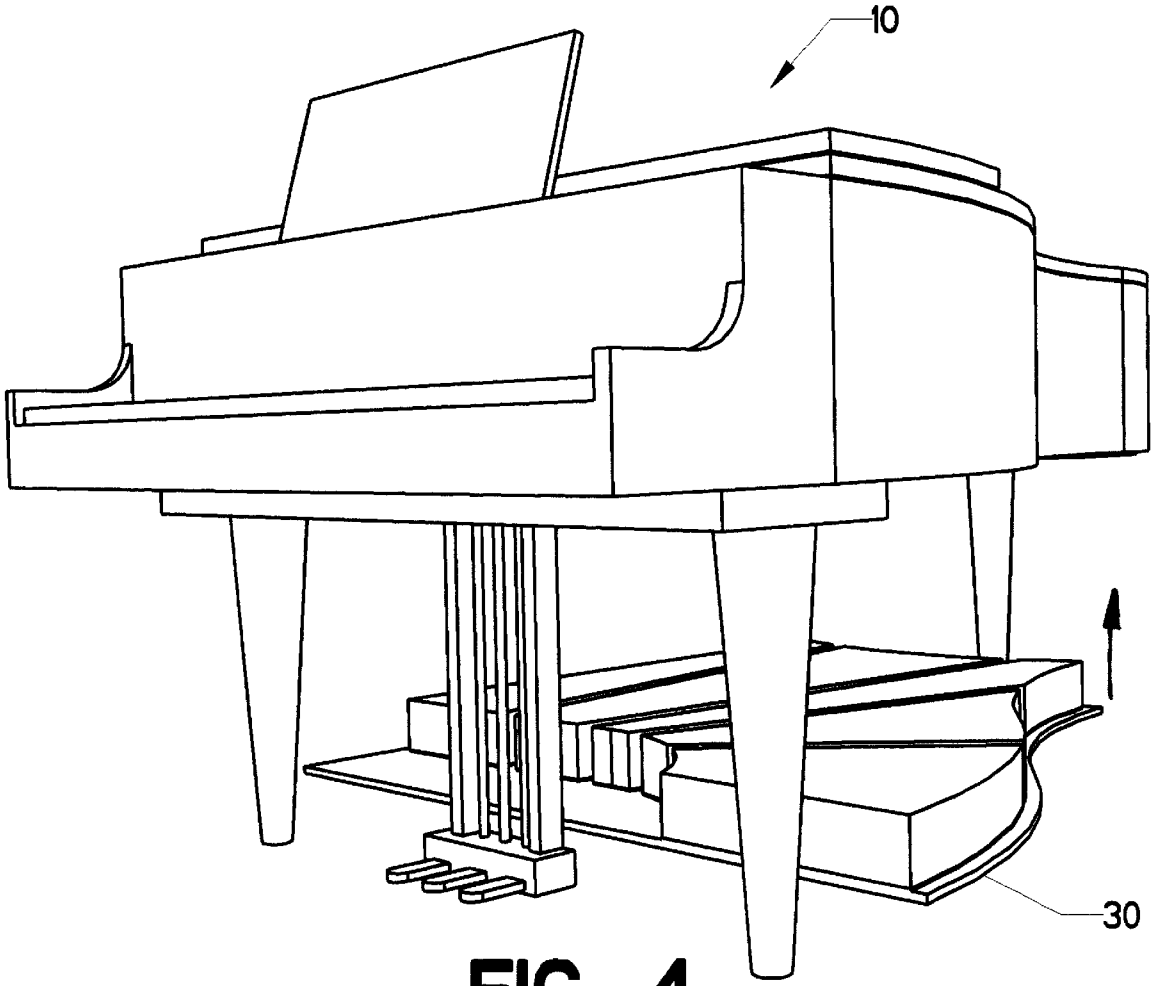
FIG. 4 is a perspective view, showing the proposed invention being installed in a concert piano.

FIG. 4 shows piano muter 30 placed below piano 10, in preparation for installation. Sheet 34 is preferably made of flexible material so that the user can lift individual portions and push them up into place, without having to lift the entire device simultaneously. Acoustic foam blocks 32 are compressible and resilient. They are preferably made larger than beam gaps 48 so that they must be compressed in order to fit within beam gaps 48. This compression introduces frictional engagement between beams 26 and acoustic foam blocks 32, which serves to retain the device in the installed position.

Figure 5:
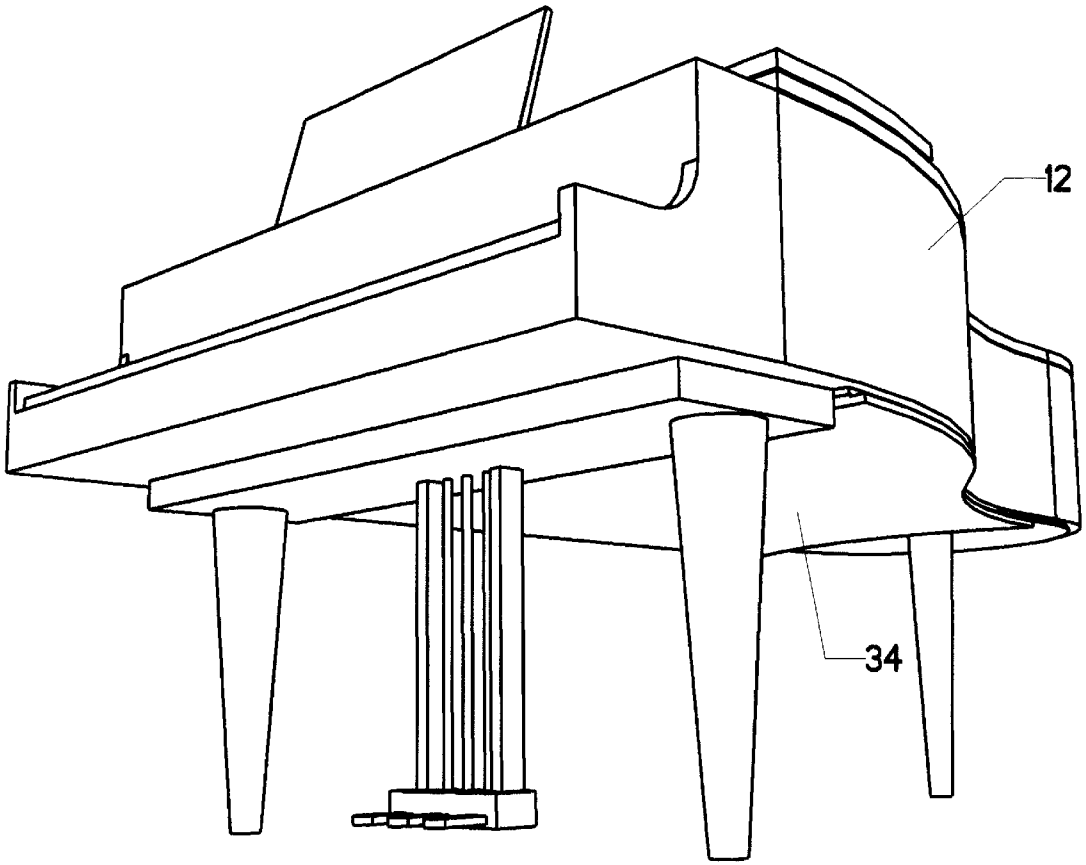
FIG. 5 is a perspective view, showing the proposed invention installed in a concert piano.

FIG. 5 shows piano muter 30 properly installed. The reader will observe that sheet 34 is flush with the bottom of piano 10. The presence of acoustic foam blocks 32 within beam gaps 48 attenuates the sound emitted from the bottom of piano 10.

In configuring the thickness of acoustic foam blocks 32, it is important to decide whether they should touch soundboard 26 when installed. If a gap between soundboard 26 and acoustic foam blocks 32 remains when piano muter 30 is installed, then the resonance and other tonal characteristics of the piano will not be significantly altered. Rather, only the volume will be attenuated. If, on the other hand, acoustic foam blocks 32 actually touch soundboard 26, mechanical damping of soundboard 26 will alter the character of the sound produced (rather than simply diminishing it).

Returning to FIG. 3, those skilled in the art will realize that sheet 34 is useful for determining the installed position of acoustic foam blocks 32. If sheet 34 is made to rest flush against the bottom of frame 12 (or some other feature), then a firm reference is established for the installed position of acoustic from blocks 32. One need only then determine the appropriate thickness for the blocks.

It is possible to implement the invention as simply a set of shaped acoustic foam blocks 32, which would be shoved into place without the use of sheet 34. However, given the preceding explanation of the importance of producing or avoiding soundboard contact, the reader will appreciate the advantages represented by sheet 34.

Figure 6:
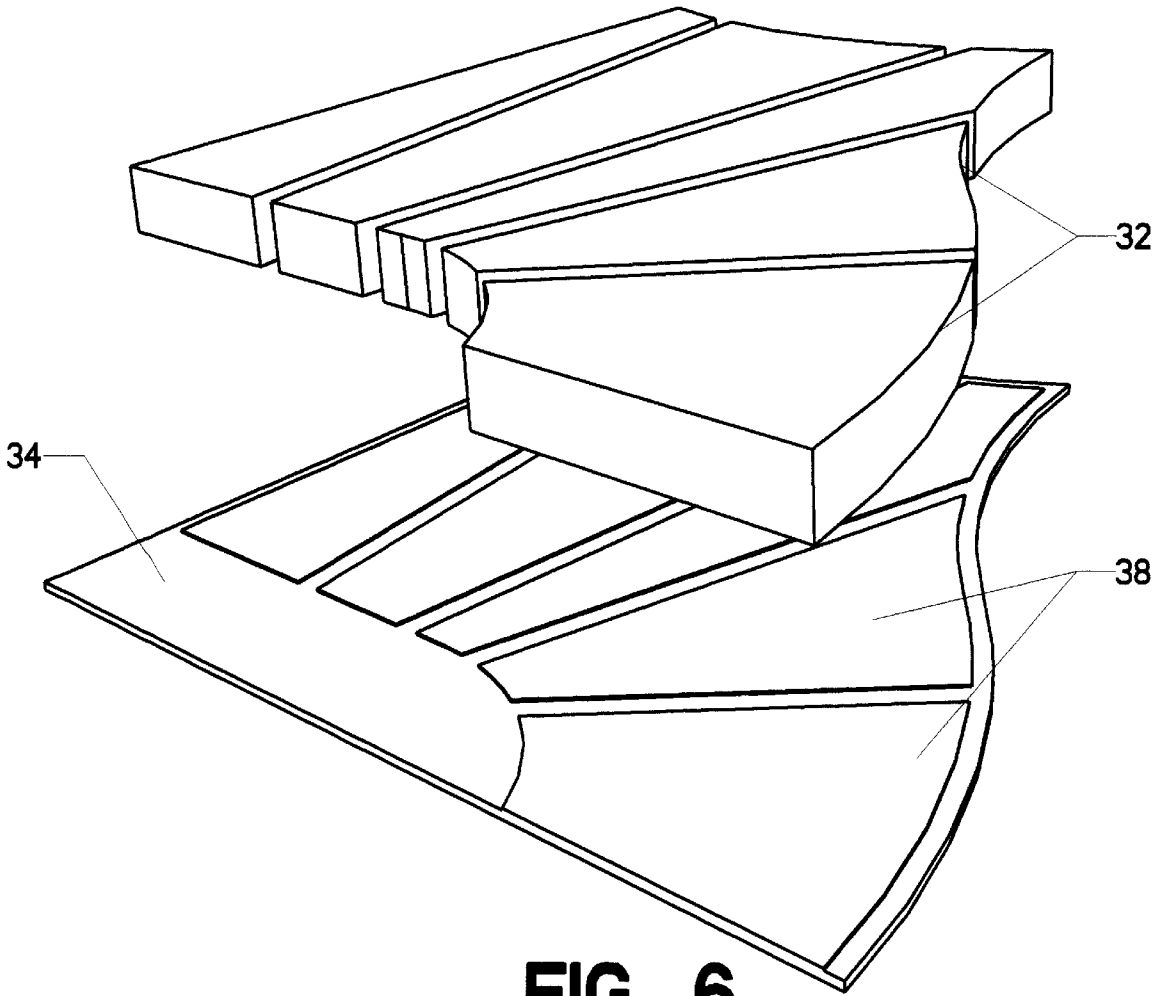
FIG. 6 is a perspective view, showing details of the proposed invention.

The material used for acoustic foam blocks 32 can be virtually any type of sound absorbing material, with soft foam being particularly effective. It is desirable to make these blocks detachable from sheet 34, in order to facilitate installation, transportation, and the replacement of damaged blocks. FIG. 6 shows sheet 34 with a set of acoustic foam blocks 32 detached. Sheet 34 has a set of VELCRO panels 38, arranged in appropriate shapes.

Figure 7:
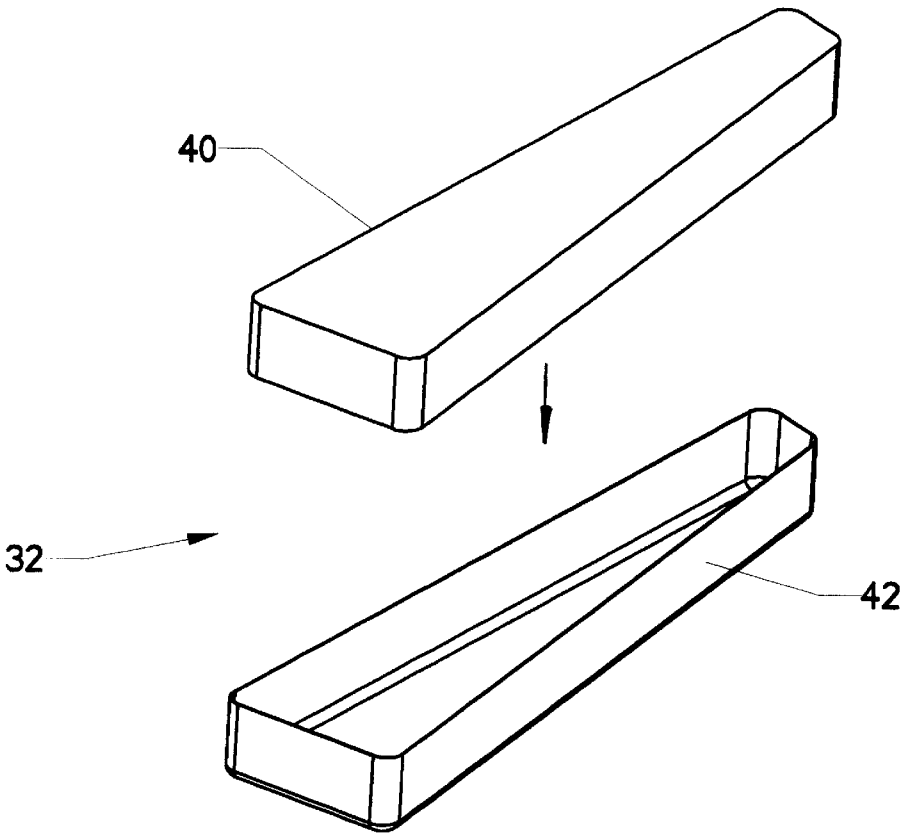
FIG. 7 is an isometric view, showing details of the proposed invention.

It is very difficult to adhesively attach materials to foam. FIG. 7 shows one solution to this problem: Each acoustic foam block 32 is made of a piece of acoustic foam 40, surrounded on several sides by NYLON shell 42 (many other types of fabric or mesh could be used). NYLON shell 42 is sewn to acoustic foam 40, or attached by other conventional means.

Figure 8:
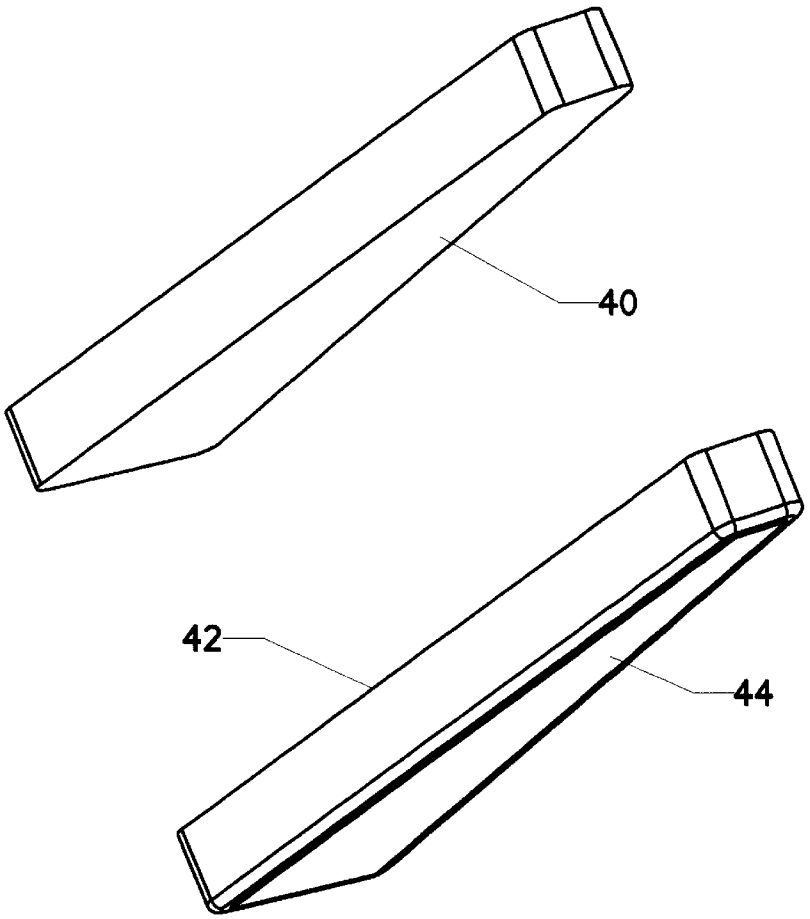
FIG. 8 is an isometric view, showing details of the proposed invention.

FIG. 8 shows the bottom of NYLON shell 42, which is covered by VELCRO panel 44. Referring to FIGS. 6, 7, and 8, the reader will appreciate that each assembled acoustic foam block 32 can be placed on sheet 34 by mating the appropriate VELCRO panel 44 to the appropriate VELCRO panel 38. The outline of VELCRO panels 38 visually guide the use in appropriately placing the various acoustic foam blocks 32. Of course, the entire upper surface of sheet 34 could be covered in VELCRO. Visual guidance could then be provided by simply printing the outlines of the acoustic foam blocks on the upper surface. Alternatively, as little securing force is needed, smaller VELCRO patches could be used.

Figure 9:
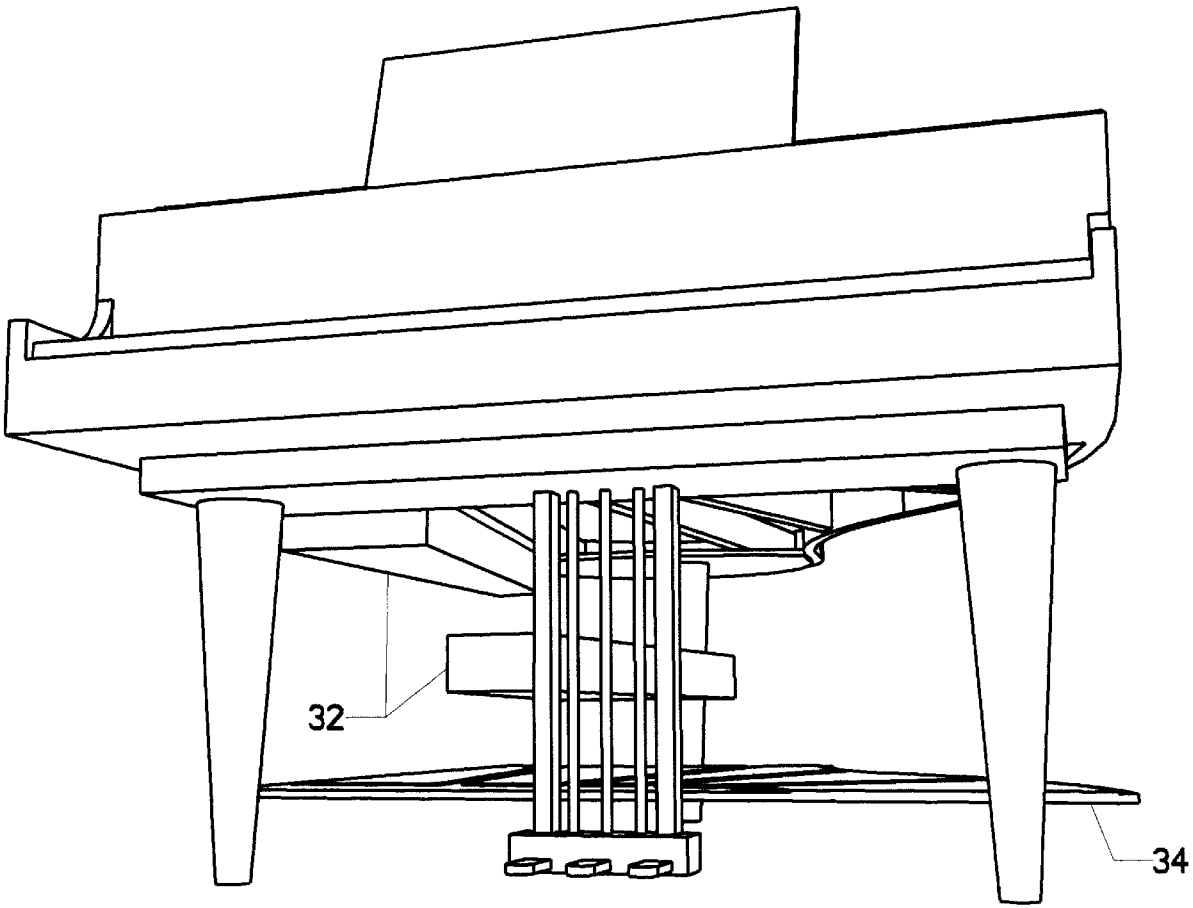
FIG. 9 is a perspective view, showing an alternate method of installing the proposed invention.

The use of detachable acoustic foam blocks 32 also provides an alternate method of installation. Some users may wish to push each acoustic foam block 32 mostly into position beneath piano 10, then attach sheet 34 and push the blocks up to their seated position. FIG. 9 graphically depicts this alternate approach.

The frictional engagement between acoustic foam blocks 32 and beams 24 is sufficient to retain the device in place, as well as supporting the attached weight of sheet 34. However, those skilled in the art will appreciate that many different methods of attaching the device could be used. As one example, sheet 34 could be attached directly to piano 10 using mechanical fasteners such as screws, clips, or VELCRO. In that variant, the frictional engagement between acoustic foam blocks 32 and beams 24 would be unimportant.

The configuration of acoustic foam blocks 32 in FIG. 3 provides approximately uniform sound attenuation across the frequency range of the piano. However, it is possible to selectively vary the attenuation according to frequency. Persons listening to piano music often perceive notes lying within the mid range to be softer than notes within the bass and treble extremes. This is true for both objective and subjective reasons. Objectively, it is well known that higher pitches tend to be more readily perceptible over background noise. Subjectively, because the notes within a piano's mid range are most frequently played, they tend to lose some novelty and therefore be less readily perceived. Accordingly, it may be desirable to alter piano muter 30 in order to attenuate certain frequencies more than others.

Figure 10:
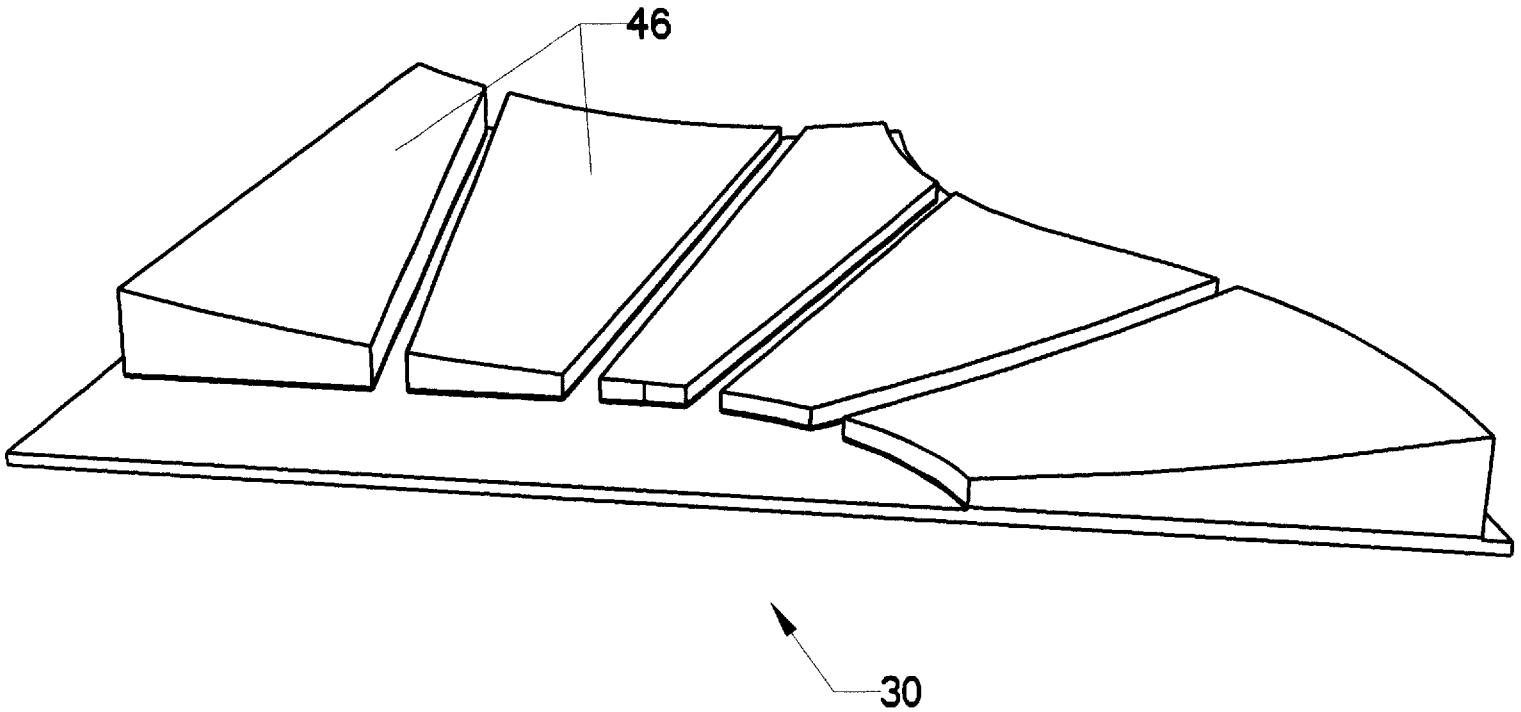
FIG. 10 is a perspective view, showing a frequency-modified version of the proposed invention.

FIG. 10 shows piano muter 30 with profile modified blocks 46. Those blocks lying beneath the piano's mid range are thinner than those lying beneath the bass and treble sections. The result is that the mid range is attenuated less than the bass and treble sections, resulting in a more balanced tone to the listener. Of course, many different effects are possible by altering the profile of the blocks. One could just as easily attenuate the bass and treble sections to produce a subjective "boost" in the mid range. In general, the foam blocks should be thicker in the bass section in order to achieve a balanced attenuation.

Those skilled in the art will realize that pianos come in many differently sizes and shapes. The figures presented thus far have been particular to a grand of piano. Even within this type, many variations must be accommodated. As an example, some such pianos have only three beams. Obviously, the particular shape of piano muter 30 can be altered to fit any of these variations.

Figure 11:
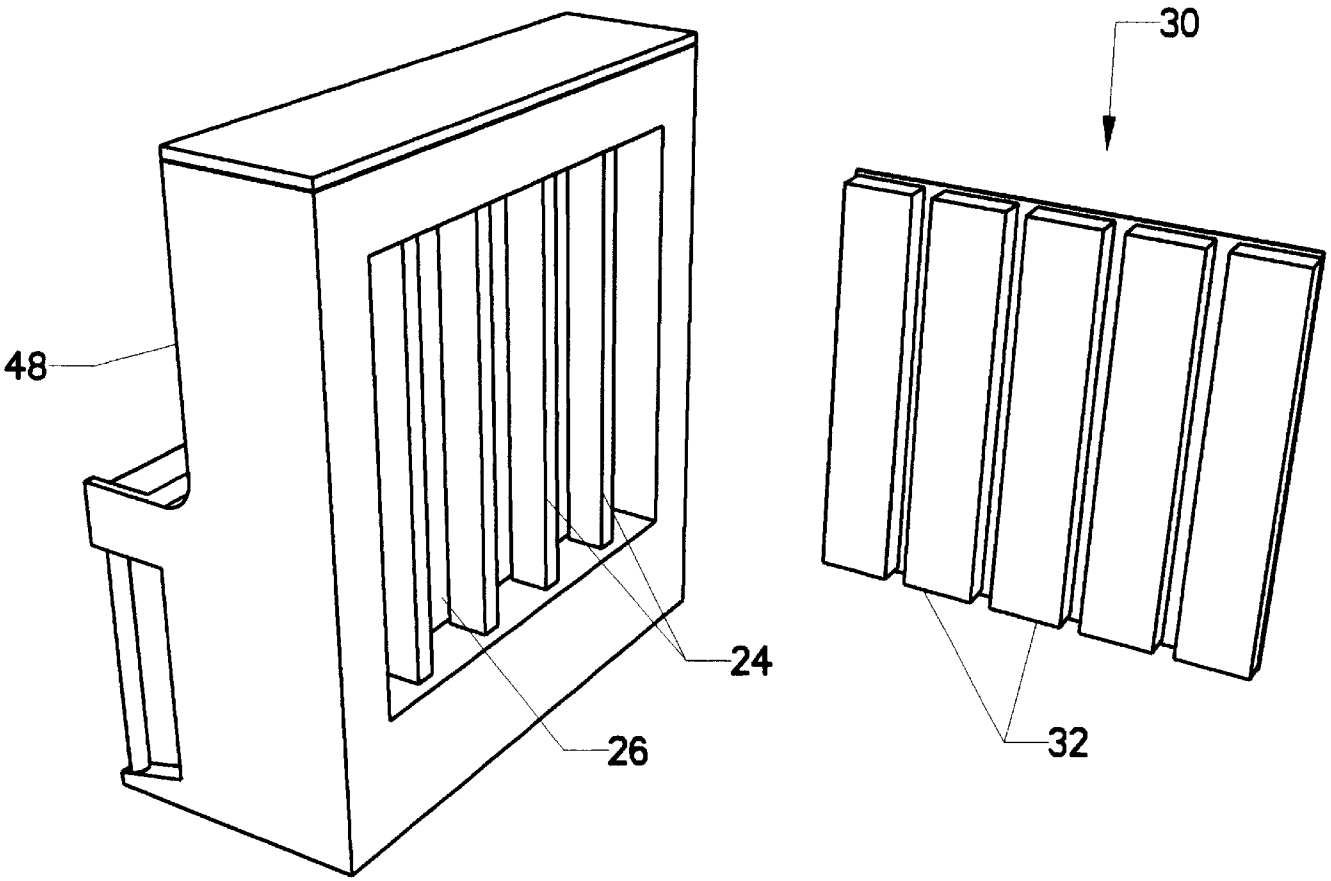
FIG. 11 is a perspective view, showing a version of the proposed invention configured to fit an upright piano.

Some pianos also employ radically different structure. FIG. 11 depicts upright piano 48. This type of instrument still employs strings and a soundboard. Both the strings and the soundboard are oriented vertically, however. Beams 24 are located in the rear of the piano, just behind soundboard 26. A modified version of piano muter 30 is shown. Like the previous embodiments, it also has sheet 34 and acoustic foam blocks 32. It is installed in the rear of the instrument, however, rather than the bottom. This alternate embodiment serves to illustrate the fact that piano muter 30 can be altered for use with virtually any type of piano.

The use of separate foam blocks 32 is advantageous in that they securely obstruct the spaces between beams 24. Those skilled in the art will realize, however, that piano muter 30 could also be made as a single piece of foam. The foam itself would then be cut to fit the outline of the piano and secured in place using mechanical fasteners.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A muter for attenuating the sound produced by a piano, wherein said piano includes strings lying approximately in a single plane, an approximately planar soundboard, having a first side and a second side, situated proximate said strings and lying approximately parallel to said plane of said strings with said first side proximate to said strings and said second side distal from said strings, and a plurality of beams proximate said second side of said soundboard, comprising:

a. a sound dampening element, placed proximate said second side of said soundboard without actually touching said soundboard;

b. wherein said sound dampening element comprises a plurality of sound-attenuating blocks, sized to fit within a plurality of beam spaces between said plurality of beams; and c. means for retaining said sound dampening element proximate said soundboard.

2. A muter as recited in claim 1, wherein:

a. said sound-attenuating blocks are compressible; and b. said means for retaining said sound dampening element comprises frictional engagement between said plurality of compressible blocks and said plurality of beams when said plurality of blocks are compressed for insertion within said beam spaces.

3. A muter as recited in claim 2, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

4. A muter as recited in claim 1, wherein:

said means for retaining said sound dampening element comprises mechanical fasteners attaching said sound-attenuating blocks to said piano.

5. A muter as recited in claim 4, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

6. A muter as recited in claim 1, wherein:

a. said sound-attenuating blocks are attached to a sheet for maintaining said plurality of sound-attenuating blocks in the correct position;

b. said sound-attenuating blocks are compressible; and c. said means for retaining said sound dampening element comprises frictional engagement between said plurality of compressible sound-attenuating blocks and said plurality of beams when said plurality of sound-attenuating blocks are compressed for insertion within said beam spaces.

7. A muter as recited in claim 6, wherein said means for retaining said sound dampening element comprises mechanical fasteners attaching said sheet to said piano.

8. A muter as recited in claim 6, wherein:

a. each of said plurality of sound-attenuating blocks includes a block of acoustic foam, having an upper surface facing said soundboard and a lower surface facing said sheet, a surrounding fabric shell, and a VELCRO panel attached to said lower surface; and b. said sheet includes an upper surface facing said sound-attenuating blocks, wherein said upper surface includes a VELCRO panel positioned to engage said VELCRO panel on each of said sound-attenuating blocks in order to attach said plurality of sound-attenuating blocks to said panel.

9. A muter as recited in claim 8, wherein said sheet further includes visual references for indicating the proper position for each of said sound-attenuating blocks with respect to said sheet.

10. A muter as recited in claim 7, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

11. A muter as recited in claim 2, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

12. A muter as recited in claim 9, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

13. A muter as recited in claim 7, wherein:

a. each of said plurality of sound-attenuating blocks includes a block of acoustic foam, having an upper surface facing said soundboard and a lower surface facing said sheet, a surrounding fabric shell, and a VELCRO panel attached to said lower surface; and b. said sheet includes an upper surface facing said sound-attenuating blocks, wherein said upper surface includes a VELCRO panel positioned to engage said VELCRO panel on each of said sound-attenuating blocks in order to attach said plurality of sound-attenuating blocks to said panel.

14. A muter as recited in claim 7, wherein said sheet further includes visual references for indicating the proper position for each of said sound-attenuating blocks with respect to said sheet.

15. A muter as recited in claim 8, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

16. A muter as recited in claim 14, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

17. A muter as recited in claim 6, wherein:

a. said approximate plane of piano strings has a left side and a right side;

b. said strings in said piano are timed to produce a procession of staggered pitches commencing with a lowest pitch proximate said left side and proceeding to a highest pitch proximate said right side; and c. wherein the thickness of said plurality of sound-attenuating blocks varies from said left side of said approximate plane of piano strings to said right side so as to vary the attenuation of the sound according to the pitch of the sound.

18. A muter as recited in claim 1, wherein:

a. said approximate plane of piano strings has a left side and a right side;

b. said strings in said piano are tuned to produce a procession of staggered pitches commencing with a lowest pitch proximate said left side and proceeding to a highest pitch proximate said right side; and c. wherein the thickness of said sound dampening element varies from said left side of said approximate plane of piano strings to said right side so as to vary the attenuation of the sound according to the pitch of the sound.

* * * * *